US007745999B2

(12) United States Patent
Graf et al.

(10) Patent No.: US 7,745,999 B2
(45) Date of Patent: Jun. 29, 2010

(54) LAMP WHICH IS CLOSED ON TWO SIDES

(75) Inventors: Jurgen Graf, Augsburg (DE); Andreas Hohlfeld, Berlin (DE); Michael Hulsemann, Schonwalde (DE); Anton Schogl, Biberbach (DE); Karen Twesten, Berlin (DE)

(73) Assignee: OSRAM Gesellschaft mit beschraenkter Haftung, Munich (DE)

( * ) Notice: Subject to any disclaimer, the term of this patent is extended or adjusted under 35 U.S.C. 154(b) by 269 days.

(21) Appl. No.: 11/804,415

(22) Filed: May 19, 2007

(65) Prior Publication Data

US 2007/0222386 A1 Sep. 27, 2007

Related U.S. Application Data

(62) Division of application No. 10/855,623, filed on May 28, 2004, now Pat. No. 7,253,562.

(30) Foreign Application Priority Data

Jun. 5, 2003 (DE) ..... 103 25 553

(51) Int. Cl.
*H01J 17/18* (2006.01)

(52) U.S. Cl. ..... 313/623; 313/624; 313/625; 313/238

(58) Field of Classification Search ..... 313/623–625, 313/318.01, 285, 288, 286, 287, 289, 290, 313/634
See application file for complete search history.

(56) References Cited

U.S. PATENT DOCUMENTS 4,404,491 A 9/1983 Siaens
5,010,272 A 4/1991 Eckhardt
5,128,589 A 7/1992 Dakin
5,304,892 A 4/1994 Lewandowski et al.
5,576,598 A 11/1996 Zaslavsky
5,932,955 A 8/1999 Berger
6,203,169 B1 * 3/2001 Coushaine et al. ..... 362/652
2002/0063529 A1 5/2002 Fukai (Continued)

FOREIGN PATENT DOCUMENTS

CA 2042143 12/1991

(Continued)

OTHER PUBLICATIONS

JP office action of Japanese patent application No. 2004-166043 dated Aug. 21, 2009.

(Continued)

*Primary Examiner*—Nimeshkumar D. Patel
*Assistant Examiner*—Peter R Haderlein

(57) ABSTRACT

The elongate bulb (1) of the lamp, which defines a longitudinal axis (A), is closed at opposite ends by sealing parts (6; 32), with in each case one cap being fitted at one end, the cap having an electrical contact element (13; 25) which is connected in an electrically conductive manner to a supply conductor (15; 21) leading to a luminous means, the contact element being accommodated in a tubular extension (11; 22) of the sealing part; the contact element (13; 25) has an attachment part (14; 24) which is directed inward toward the lamp interior and is equipped with at least two barbs (20; 26) which are in contact with the tubular extension (11; 21).

24 Claims, 5 Drawing Sheets

U.S. PATENT DOCUMENTS

| | | | | |
|---|---|---|---|---|
| 2002/0067115 | A1 | 6/2002 | Nagata | |
| 2006/0022570 | A1 * | 2/2006 | Frye et al. ..... | 313/318.02 |

FOREIGN PATENT DOCUMENTS

| | | | |
|---|---|---|---|
| JP | 1297875 | A | 11/1989 |
| JP | 2000357492 | A1 | 12/2000 |
| JP | 2001010905 | A1 | 1/2001 |
| JP | 2001345071 | A1 | 12/2001 |
| JP | 2002305470 | A1 | 10/2002 |

OTHER PUBLICATIONS

English translation of relevant JP office action passage for JP 49-063 278.
English language abstract for JP__2001010905__A1.
English language abstract for JP__2002305470__A1.
English language abstract for JP__2000357492__A1.
English language abstract for JP__2001345071__A1.
English language abstract for JP 1297875 A.
German translation of Japanese Office Action dated Feb. 5, 2010.

* cited by examiner

LAMP WHICH IS CLOSED ON TWO SIDES

TECHNICAL FIELD

This application is a divisional of U.S. patent application Ser. No. 10/855,623 filed on May 28, 2004, now U.S. Pat. No. 7,253,562 which issued Aug. 7, 2007, which claimed the benefit of the filing date of German patent application 10325553.2, filed on Jun. 5, 2003, the disclosures of which are incorporated herein by reference. The invention relates to a lamp which is closed on two sides and has an elongate bulb, which is closed off in a vacuum-tight manner, defines a longitudinal axis and is closed at opposite ends by sealing parts, with in each case one cap being fitted at one end, the cap having an electrical contact element which is connected in an electrically conductive manner to a supply conductor leading to a luminous means, the contact element being accommodated in a tubular extension of the sealing part. It deals in particular with metal halide lamps.

BACKGROUND ART

U.S. Pat. No. 5,932,955 has already disclosed a lamp which is closed on two sides and in which two cap parts have contact elements which are seated in tubular extensions at the end of pinches which are responsible for sealing. The contact elements extend transversely with respect to the lamp axis and are surrounded by the tubular extensions as sleeves. Securing is effected along the circumference of the contact elements. One drawback of this is that the contact elements can easily become tilted, and consequently they are no longer positioned exactly transversely with respect to the lamp axis and, moreover, the risk of fracturing is relatively high.

DISCLOSURE OF THE INVENTION

It is an object of the present invention to provide a lamp which is closed on two sides and has an elongate bulb, which is closed off in a vacuum-tight manner, defines a longitudinal axis and is closed at opposite ends by sealing parts, with in each case one cap being fitted at one end, the cap having an electrical contact element which is connected in an electrically conductive manner to a supply conductor leading to a luminous means, the contact element being accommodated in a tubular extension of the sealing part, and which lamp has a simple, securely fitted and precisely oriented cap.

This object is achieved by an adjustment part, which is directed toward the lamp interior and is equipped with at least two outwardly protruding centering parts which are in contact with the tubular extension, and in some embodiments the adjustment part is attached to the contact element. Particularly advantageous configurations are to be found in the dependent claims.

The lamp which is closed on two sides in accordance with the invention has an elongate bulb, which is closed off in a vacuum-tight manner, defines a longitudinal axis and is closed at opposite ends by sealing parts, with in each case one cap being fitted at one end of the sealing part. The cap has an electrical contact element which is connected in an electrically conductive manner to a supply conductor leading to a luminous means in the interior of the lamp. According to the invention, the contact element, together with an adjustment part, is anchored in a tubular extension of the sealing part. The adjustment part, which is directed toward the lamp interior, is connected to the contact element. It has at least two centering parts which are directed radially outward and are in contact with the tubular extension. The contacting serves either to hold or at least adjust the contact element, and preferably serves both purposes.

In a preferred embodiment, the centering parts comprise a plurality of, in particular three to four, barbs. These are preferably distributed over the circumference of an adjustment part which serves as an attachment part for the contact element.

It is preferable to use three barbs which are distributed uniformly over the circumference of the attachment part. They are therefore arranged at intervals of 120° with respect to one another. This ensures reliable centering with little outlay on material.

In particular, the attachment part, barbs and contact element are produced from a single piece, in which case the material used is generally stainless steel, tungsten or molybdenum. However, the barbs may also be made separately from another material, in particular a nonconductive material, such as plastic or ceramic.

The extension part may have a sleeve for accommodating the supply conductor.

In principle, the above concept is suitable for numerous types of lamps, in particular for discharge lamps or incandescent lamps. It is particularly preferable for lamps with an outer bulb. In this case, the outer bulb may completely or partially surround the discharge vessel. The lamp shanks may be pinches or fused seals.

It is preferable for the barbs to be arranged obliquely with respect to the lamp axis, so that they can be inserted into the sleeve more easily, and specifically it is preferable for them to form an angle of from 50 to 80°, in particular 60 to 70°, with the lamp axis. It is usual for the contact element to be disk-like in form, and specifically, in general, to be configured as a circular disk or an oval with a smooth or jagged edge.

To ensure reliable holding, the barbs are advantageously at a distance of at least 2 mm, advantageously even 5 mm, from the contact element.

In one particularly preferred embodiment, the cap comprises an adjustment part made from spring sheet. It comprises a base part, which covers one plane and from which two differently configured centering parts project radially in opposite directions. The first centering part is shaped similarly to a W and projects out of the plane of the base part along the latter. The two reversal points in the W are in contact with the extension part of the sealing part, and in particular at least one of the reversal points is even fused into the extension part, and moreover the second centering part connects the contact element to the base part, which imparts additional stability. The base part may comprise two struts which run laterally with respect to the supply conductor and are connected by at least one connecting bridge, also referred to as a yoke. It is preferable for there to be two or even three connecting bridges in different planes. This further improves stability.

The supply conductor may be in contact with some of the connecting bridges or may be fixedly connected thereto, which promotes the exactness of centering. This aspect is improved still further by virtue of the first centering element having a free end which is forked, so that it can automatically adjust to the supply conductor.

The overall structure is reinforced by virtue of the contact element being connected to the supply conductor both directly and via a centering element.

A particularly preferred embodiment is a second centering part, which comprises two centering elements spaced apart from one another. The further apart from one another the centering elements are, the more precise the centering is. A preferred minimum distance is given by double the diameter of the contact element.

One typical application is metal halide lamps and incandescent halogen lamps.

BRIEF DESCRIPTION OF THE DRAWINGS

The following text is intended to provide a more detailed explanation of the invention with reference to a plurality of exemplary embodiments. In the drawings.

BEST MODE FOR CARRYING OUT THE INVENTION

Figure 1:
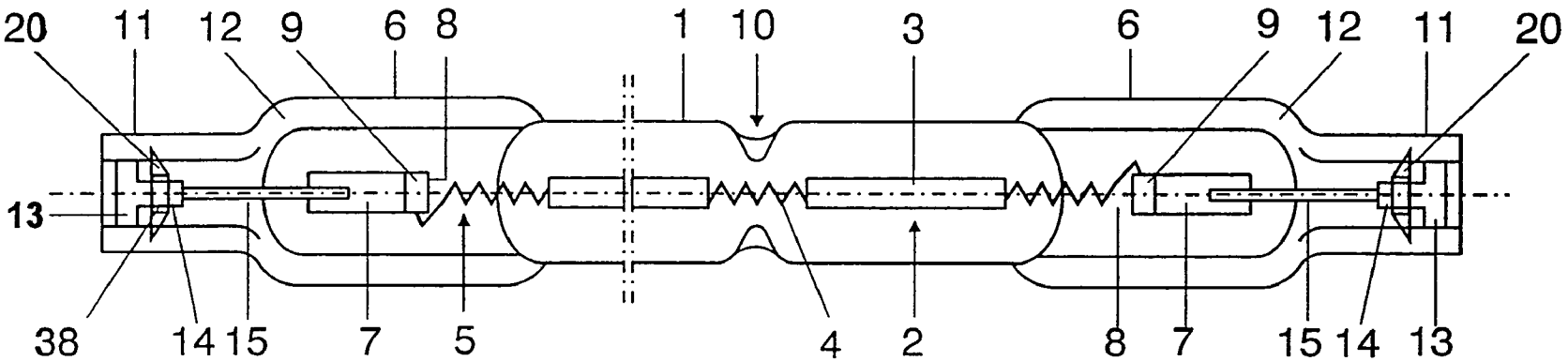
FIG. 1 shows a side view of an incandescent halogen lamp.

FIG. 1 shows a side view of an incandescent halogen lamp which is pinched on two sides. It comprises a cylindrical bulb 1 in which a luminous body 2 is arranged axially. The luminous body is held in the bulb 1 by lugs 10.

The luminous body 2 comprises luminous sections 3 with a small pitch which are separated from one another by non-luminous sections 4 with a large pitch. The ends 5 of the luminous body also comprise non-luminous sections with a large pitch. With regard to their function as internal supply conductor, the ends 5 are embedded directly in the pinch 6, where they are connected to a pinch foil 7. That end 8 of the foil 7 which faces the luminous body is bent over within the pinch 6, with the luminous body end 5 being introduced into the bend 9, thereby producing an electrical contact with the foil 7 by purely mechanical means.

A tubular glass sleeve 11 with an external diameter of 7 mm and an internal diameter of 5 mm is formed integrally on the outside of the pinch 6 as a cap. The sleeve 11 is approximately 7 mm long. It is therefore narrower than the wide side of the pinch 6 but wider than the narrow side of the pinch 6. Accordingly, there is a transition zone 12 between pinch 6 and sleeve 11.

Figure 2:
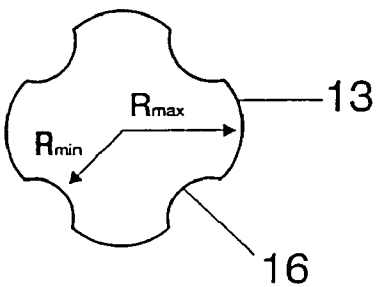
FIG. 2 shows a contact element for the lamp from FIG. 1.

A disk-like contact element 13, which is made from steel sheet (V2A) with a thickness of 0.4 mm, is embedded in the sleeve 11 at a depth of 3 mm from the end of the sleeve, transversely with respect to the lamp axis. It is configured as a circular disk or alternatively in the shape of a cloverleaf (cf. FIG. 2), in which case the maximum radius of the disk 13 (Rmax) is 2.7 mm and the minimum radius (Rmin) is 2.0 mm. The latter is reached at the base of in each case four recesses 16. The recesses 16 are stamped out of the disk as concave arcs of a circle. The recesses 16 serve in particular as a grip aid for holding by means of pliers.

Figure 5C:
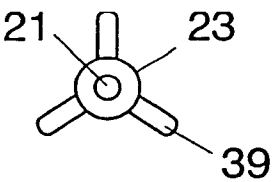
FIG. 5 shows a front view of three exemplary embodiments (FIGS. 5*a*, 5*b*, 5*c*) of barbs.

A hollow neck part 14 is attached to the rear side of the element 13. A molybdenum wire with a diameter of 0.6 mm as outer supply conductor 15, which is welded to the neck part 14, is arranged between foil 7 and element 13. Two barbs 20 located opposite one another and made from plastic or ceramic are secured to the neck part by means of a ring 38, with their tips anchored in the sleeve 11. The rings 38 with barbs 20 are shown in a front view in FIG. 5*a*.

Figure 3C:
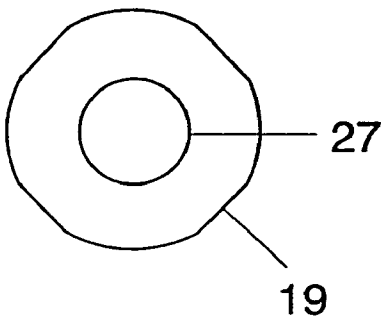
FIG. 3 shows further exemplary embodiments of contact elements.
Figure 3B:
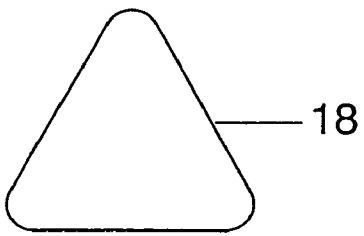
Figure 3A:
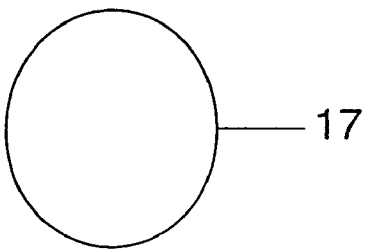

FIG. 3 shows still further possible basic forms of the contact element. Specifically, these are an elliptical form 17 (FIG. 3*a*), a triangle-like form 18 (FIG. 3*b*) and a quadrilateral-like form 19 (FIG. 3*c*). The basic form of the latter is a 0.5 mm thick disk which has a concave, central bulge 27 with a diameter of 3 mm. The maximum diameter of the disk is 5.4 mm, while its smallest diameter is 5 mm. The corners of the triangle and quadrilateral are rounded.

Figure 4:
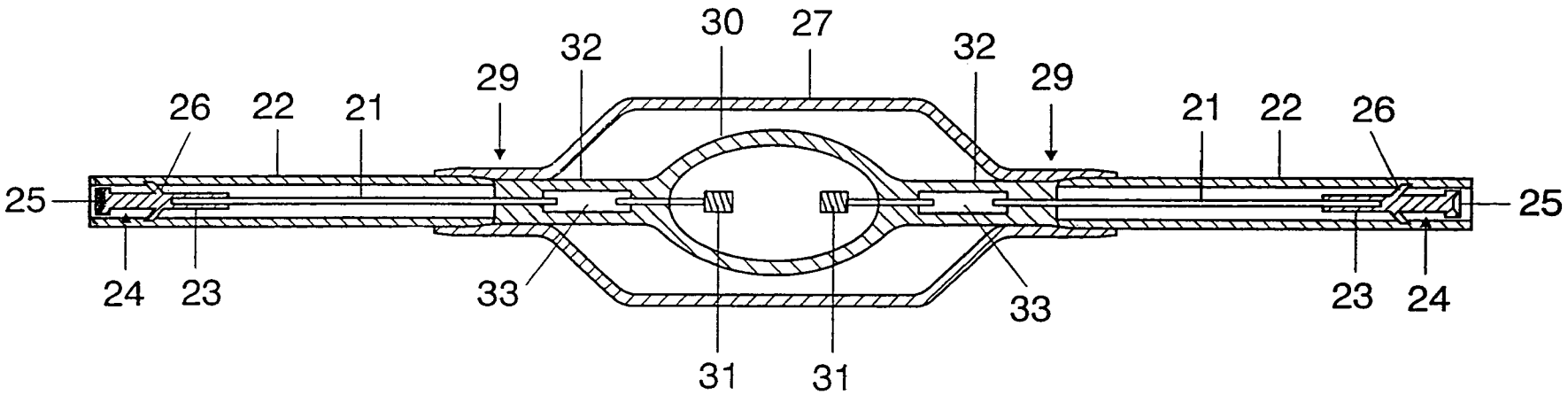
FIG. 4 shows a side view of an exemplary embodiment of a metal halide lamp.
Figure 5B:
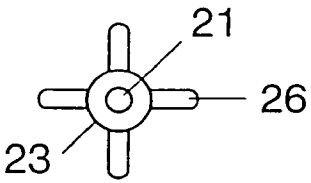
Figure 5A:
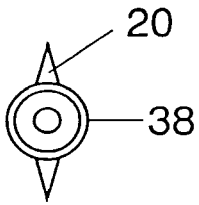

A further exemplary embodiment of a metal halide lamp is shown in FIG. 4. Unlike in FIG. 1, the discharge vessel, which is designed as a barrel-like body 30 and is made from quartz glass, encloses two electrodes 31 as well as a metal halide fill. The bulb ends are sealed by pinches 32 in which foils 33 are embedded. The outer supply conductor 21 is guided inside a tubular sleeve 22, which in this case forms an extension of the discharge vessel, and ends in a bush 23 of an integral cap part 24. The cap is produced as a single part from steel and, moreover, comprises a circular disk 25 as contact element and four barbs 26 as centering and holding means. The bulging part of the discharge vessel is surrounded by an outer bulb 27 which is rolled on (29) in the region of the transition between the pinch 32 and the sleeve 22. FIG. 5*b* shows a front view of the arrangement of the barbs 26.

A further exemplary embodiment (FIG. 5*c*) uses three barbs 39 distributed uniformly around the circumference, with the result that reliable centering with minimum outlay on materials is already achieved.

A possible form of production is described, for example, in US 2002/063 529, US 2002/067 115 or U.S. Pat. No. 5,128, 589. A variant with a complete outer bulb is given, for example, in CA 2 042 143. The concept according to the invention can be used for all these designs.

Figure 6:
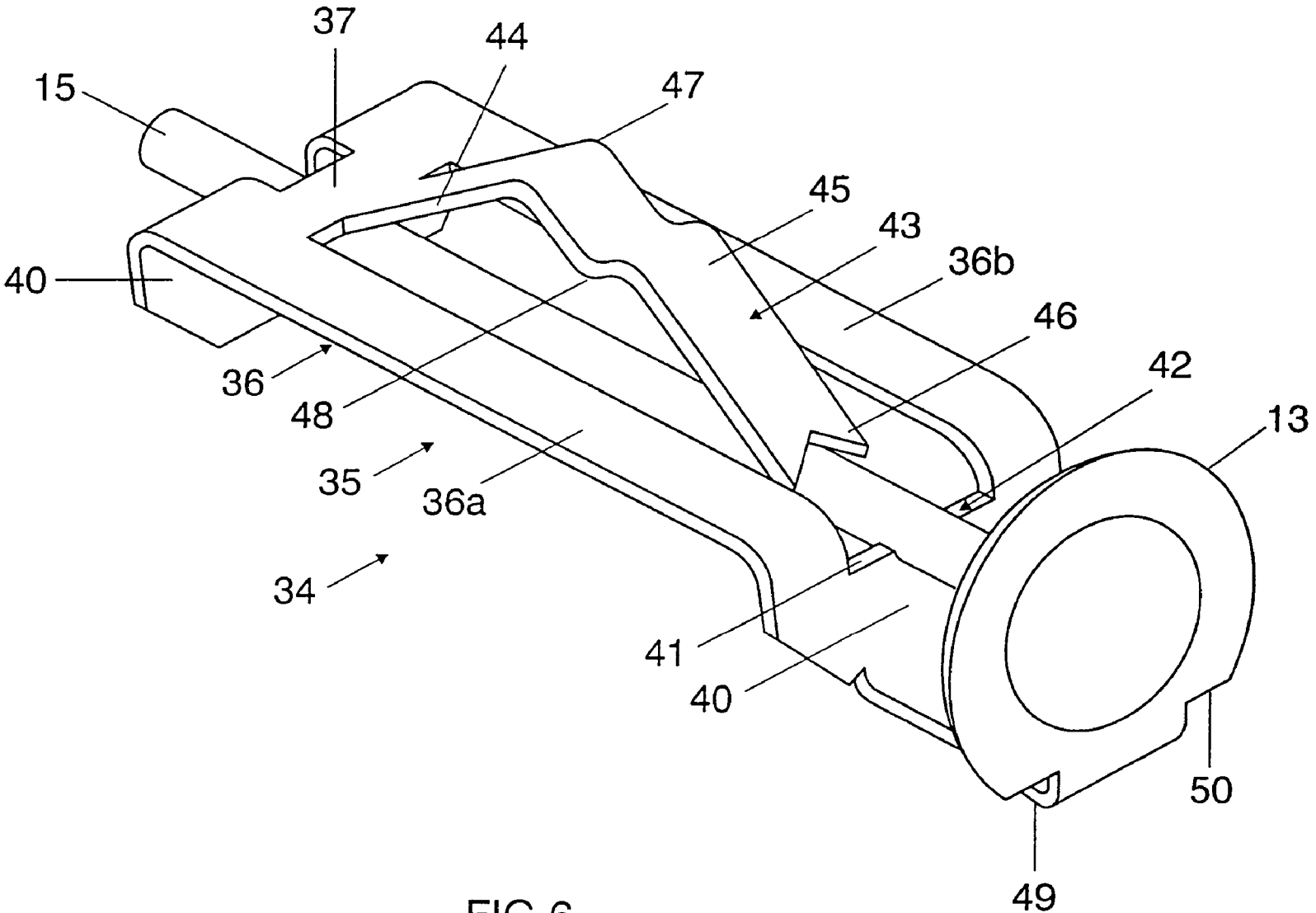
FIGS. 6 and 7 show perspective and sectional views of a further exemplary embodiment of a cap.
Figure 7A:
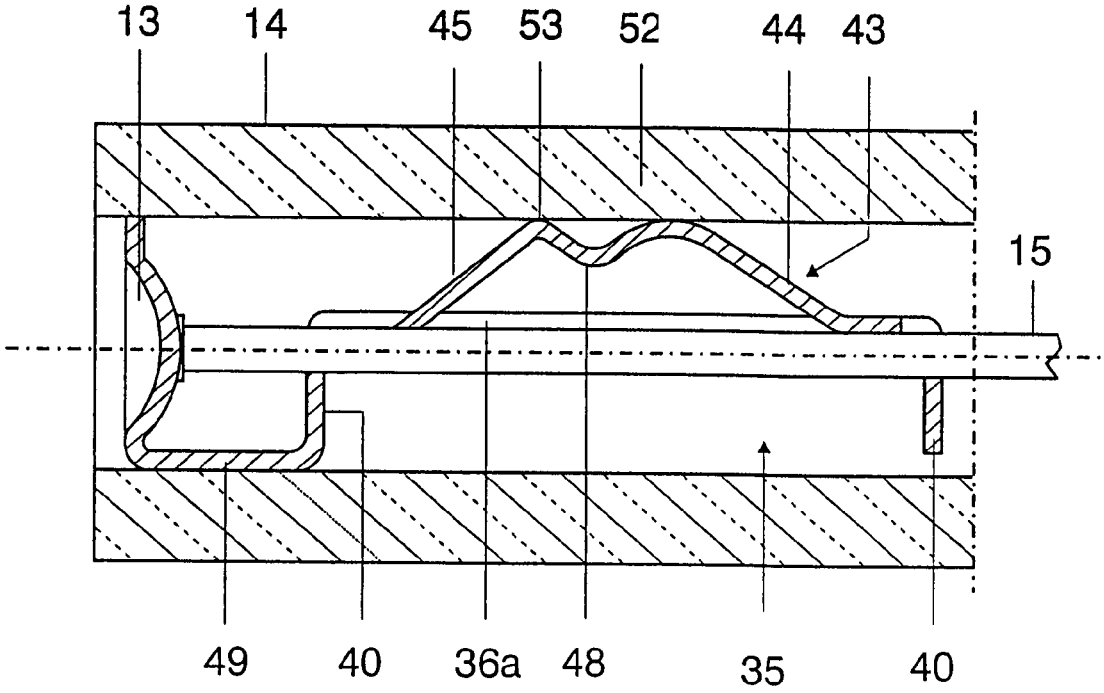
Figure 7B:
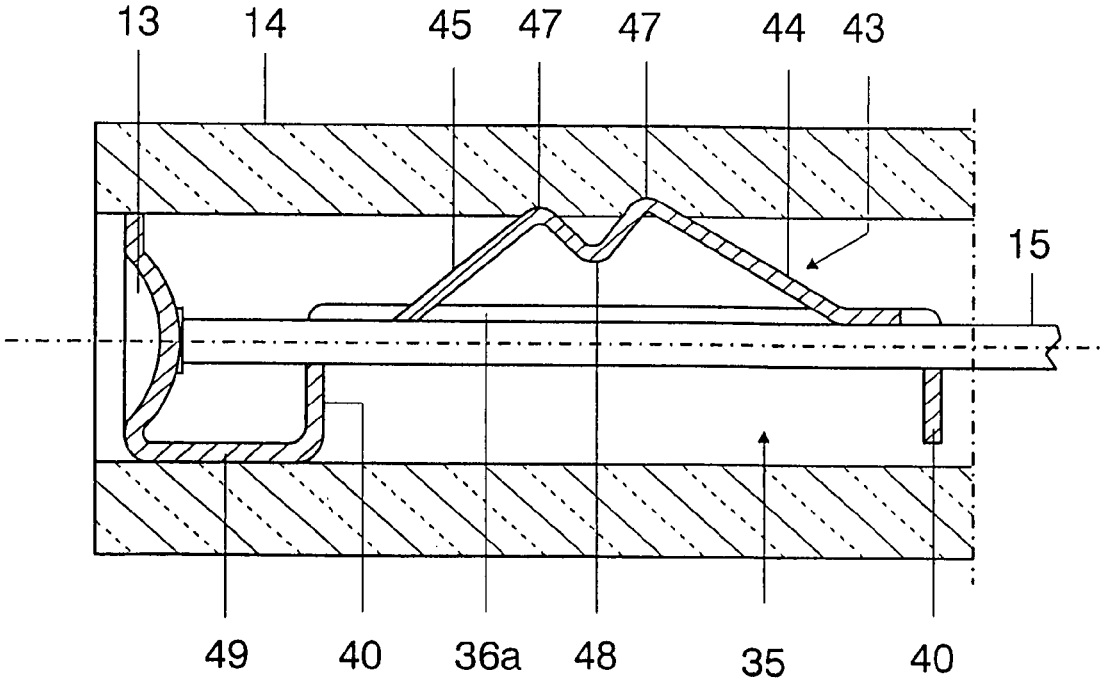

A further exemplary embodiment of a cap is shown in FIG. 6. The cap part 34 comprises a plate-like contact element 13 with a diameter D, the center of which is directly attached to the external supply conductor 15. In this case, however, the adjustment part 35 is formed from spring sheet in such a way that it has a particularly stable, vibration-resistant and centering effect. For this purpose, the adjustment part 35 has a planar base part 36 similar to a carriage. It is composed of two struts 36*a*, 36*b*, which run parallel to the external supply conductor 15, and a yoke 37, which lies in the same plane, at one end of the struts 36*a, b* running parallel. The yoke 37 connects the two struts 36*a*, 36*b*. Two transverse walls 40, which are arranged at the two ends of the base part 36, perpendicular to the plane of the base part, below the base part, impart additional stability. They too act as a yoke, which connects the two struts 36*a*, 36*b*, albeit angled off by 90° with respect thereto. The supply conductor 15 rests on the side walls 41, facing the base part 36, of the transverse walls and may be connected to them, for example by soldering or welding. The transverse wall 40 may also, as shown, have a cutout 42 for partially accommodating the supply conductor 15. A first centering part 43, which extends radially outward, is attached centrally to the yoke 37. It is configured as a spring sheet which is bent in a V or W shape, with one limb 44 originating from the yoke 37 while the second, free limb 45 points toward the supply conductor 15 and contact element 13. To assist the centering action, the free end of the second limb is forked (46) and, in the installed state, bears against the supply conductor 15. The two extreme reversal points 47 attached to the limbs are at least mechanically in contact with the neck part, cf. FIG. 7, and under certain circumstances at least one of the reversal points 47 may be fused into the glass of the neck part. Approximately in the center between the two reversal points there is a turning point 48 which is oriented in the direction of the supply conductor 15. The centering is in principle ensured by a second centering part, by virtue of the two transverse walls 40, primarily the edges thereof, acting as centering elements. It is preferable to use an additional auxiliary centering element, which is attached as a clasp 49 to the second transverse wall 40, adjacent to the contact element, runs parallel to the plane of the struts and connects this second transverse wall 40 to the contact element 13. For this purpose, a part of the plate-like contact element 13 which is delimited by a chord 50 is removed. The clasp 49 is angled off toward this chord. The second centering part, in this case comprising three centering elements, extends in the opposite radial direction to the first centering part. It touches the inner wall of the sleeve 14, cf. FIG. 7. For precise centering, it is important in this context that the second centering element 40 be at the maximum distance possible from the first centering element, in particular be at a distance of at least twice the diameter of the contact element 13 therefrom.

The contact element 13 is advantageously at a slight distance from or at most in purely mechanical contact with the sleeve 14 along its circumference, so that there is no need for any glass-forming process. This has the beneficial effect that it is possible to use inexpensive material, such as steel, for the contact element 13. The contact element 13 is stabilized sufficiently in particular by the double reinforcement provided by the supply conductor 15 and the clasp 49. The cap part 34 overall therefore remains gas-permeable.

Figure 8:
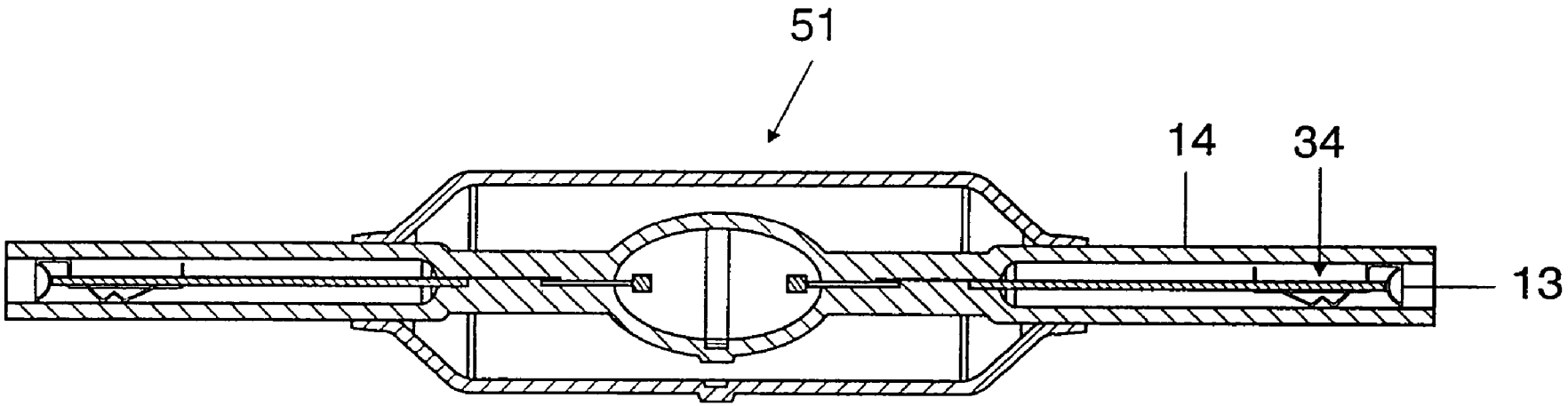
FIG. 8 shows a side view of a further exemplary embodiment of a metal halide lamp.

FIG. 8 shows an overall view of the lamp 51. The cap part 34 is accommodated in the neck part 14 by being simply mechanically wedged in place.

The transverse walls 40 and/or the clasp 49 may also have additional bent-off tabs for providing further support and stabilization.

What is claimed is:

1. A lamp which is closed on two sides and has an elongate bulb, which is closed off in a vacuum-tight manner, defines a longitudinal axis and is closed at opposite ends by sealing parts, with in each case one cap being fitted at one end, the cap having an electrical contact element which is connected in an electrically conductive manner to a supply conductor leading to a luminous means, the contact element being accommodated in a tubular extension of the sealing part, wherein an adjustment part comprises:

a base part connected to a first outwardly protruding centering part and a second outwardly protruding centering part, wherein:

the first outwardly protruding centering part provides a spring action and at least a first portion of the first outwardly protruding centering part contacts the supply conductor and at least a second portion of the first outwardly protruding centering part contacts an inner surface of the tubular extension; and the second outwardly protruding centering part comprises a first centering element, wherein the first centering element is angled off from the base part and at least a portion of the first centering element contacts the supply conductor.

2. The lamp as claimed in claim 1, wherein the first outwardly protruding centering part, further comprises a V-shaped or a W-shaped configuration.

3. The lamp as claimed in claim 2, wherein the first outwardly protruding centering part further comprises a free limb, wherein an end of the free limb comprises a forked configuration.

4. The lamp as claimed in claim 1, wherein the second outwardly protruding centering part further comprises a second centering element angled off from the base part and at least a portion of the second centering element contacts the supply conductor.

5. The lamp as claimed in claim 4, wherein the first centering element and the second centering element are at a distance from one another which corresponds to at least double the diameter of the contact element.

6. The lamp as claimed in claim 1, wherein the base part further comprises two struts which are connected via a yoke.

7. The lamp as claimed in claim 1, wherein the second outwardly protruding centering part further comprises, a clasp connected to the first centering element and the contact element.

8. The lamp as claimed in claim 1, wherein the first centering element is in the form of a wall angled off from the base part.

9. The lamp as claimed in claim 1, wherein the adjustment part comprises a spring sheet material.

10. The lamp as claimed in claim 1, wherein the base part lies substantially in one plane.

11. The lamp as claimed in claim 1, wherein the second portion of the first centering part is embedded into the tubular extension.

12. The lamp as claimed in claim 1, wherein the inner surface of the tubular extension comprises a substantially smooth surface.

13. The lamp as claimed in claim 1, wherein at least a portion of the second centering part contacts an inner surface of the tubular extension.

14. The lamp as claimed in claim 4, wherein the second centering element is in the form a wall angled off from the base part.

15. The lamp as claimed in claim 6, wherein the first centering part is connected to the yoke.

16. The lamp as claimed in claim 15, wherein the second outwardly protruding centering part further comprises a second centering element angled off from the base part and at least a portion of the second centering element contacts the supply conductor and the second outwardly protruding centering part is connected to the two struts.

17. An adjustment part for a lamp with an elongate bulb and an electrical contact element connected in an electrically conductive manner to a supply conductor leading to a luminous means, wherein the adjustment part comprises:

a base part comprising two struts which are connected via a yoke, the base part oriented between at least a portion of a first outwardly protruding centering part and at least a portion of a second outwardly protruding centering part;

the first outwardly protruding centering part providing a spring action and connected to the yoke, the first centering part comprising:

a V-shaped or W-shaped configuration; and a free limb, wherein an end of the free limb is configured to bear against the supply conductor and at least a portion of the first outwardly protruding centering part is configure to contact an inner surface of the elongate bulb; and the second outwardly protruding centering part connected to the two struts, the second outwardly protruding centering part comprising a first centering element in the form of a wall angled off from the base part and at least a portion of the first centering element is configured to contact the supply conductor.

18. The adjustment part as claimed in claim 17, wherein the second outwardly protruding centering part further comprises a second centering element angled off from the base part and at least a portion of the second centering element contacts the supply conductor.

19. The adjustment part as claimed in claim 18, wherein the second centering element is in the form of a wall angled off from the base part.

20. The adjustment part as claimed in claim 19, wherein at least a portion of the second centering element is configured to contact an inner surface of the elongate bulb.

21. The adjustment part as claimed in claim 20, wherein the first centering element and the second centering element are at a distance from one another which corresponds to at least double the diameter of the contact element.

22. The adjustment part as claimed in claim 17, wherein the second outwardly protruding centering part further comprises a clasp connected to the first centering element, wherein the clasp is configured to connect with the contact element.

23. The adjustment part as claimed in claim 17, wherein the base part lies substantially in one plane.

24. The adjustment part as claimed in claim 17, wherein the adjustment part comprises a spring sheet material.

* * * * *

UNITED STATES PATENT AND TRADEMARK OFFICE

CERTIFICATE OF CORRECTION

PATENT NO. : 7,745,999 B2
APPLICATION NO. : 11/804415
DATED : June 29, 2010
INVENTOR(S) : Jurgen Graf et al.

It is certified that error appears in the above-identified patent and that said Letters Patent is hereby corrected as shown below:

Title Page

Please correct the 4th inventor's name, line item (75) on the front page of the patent to read as follows:

"Anton Schloegel"

Signed and Sealed this
Twenty-sixth Day of April, 2011

David J. Kappos

David J. Kappos
*Director of the United States Patent and Trademark Office*